US007367301B2

(12) United States Patent
Waseda et al.

(10) Patent No.: US 7,367,301 B2
(45) Date of Patent: May 6, 2008

(54) CAM FOLLOWER

(75) Inventors: Yoshitaka Waseda, Nisshin (JP); Shinya Ochi, Hamura (JP)

(73) Assignee: Jtekt Corporation, Osaka-Shi, Osaka (JP)

( * ) Notice: Subject to any disclaimer, the term of this patent is extended or adjusted under 35 U.S.C. 154(b) by 0 days.

(21) Appl. No.: 11/723,872

(22) Filed: Mar. 22, 2007

(65) Prior Publication Data

US 2007/0221155 A1 Sep. 27, 2007

(30) Foreign Application Priority Data

Mar. 23, 2006 (JP) ..... P2006-079974

(51) Int. Cl.
*F01L 1/18* (2006.01)

(52) U.S. Cl. ..... 123/90.44; 123/90.2; 123/90.41; 123/90.39; 123/90.51; 29/888.2; 29/895; 29/895.32; 74/569; 384/625

(58) Field of Classification Search ..... 123/90.44
See application file for complete search history.

(56) References Cited

U.S. PATENT DOCUMENTS 5,361,648 A * 11/1994 Murakami et al. ..... 74/569
5,997,988 A * 12/1999 Sada ..... 428/141
6,460,498 B2 * 10/2002 Harimoto et al. ..... 123/90.41

FOREIGN PATENT DOCUMENTS

| | | |
|---|---|---|
| JP | 2594339 | 12/1996 |
| JP | 2634496 | 4/1997 |

* cited by examiner

*Primary Examiner*—Thomas Denion
*Assistant Examiner*—Kyle M. Riddle
(74) *Attorney, Agent, or Firm*—McGinn IP Law Group, PLLC

(57) ABSTRACT

There is provided a cam follower in which a surface roughness of an outer surface of a roller of a cam follower which is in rolling contact with a cam of an engine is obtained individually in an axial direction and a circumferential direction, a skewness Rsk of a profile is formed to be negative, a core roughness depth Rk is made to be 0.3 or less, a reduced valley depth Rvk is made to be 0.3 or less, and a ratio Rk/Rt of the Rk to a maximum height Rt of the profile is made to be 0.19 or more.

3 Claims, 2 Drawing Sheets

FIG. 2

TABLE SHOWING RESULTS OF AN EVALUATION OF THE INVENTION AND A CONVENTIONAL EXAMPLE WITH VARIOUS PARAMETERS OF SURFACE ROUGHNESS SET

| VARIOUS PARAMETERS OF SURFACE ROUGHNESS | CONVENTIONAL EXAMPLE | INVENTION (EXAMPLE 1) | INVENTION (EXAMPLE 2) |
|---|---|---|---|
| Rk | 0.34 | 0.30 | 0.23 |
| Rpk | 0.084 | 0.076 | 0.054 |
| Rvk | 0.37 | 0.26 | 0.30 |
| Rku | 10 | 4.87 | 7.81 |
| Rt | 1.984 | 1.528 | 1.246 |
| Rk/Rt | 0.17 | 0.20 | 0.19 |
| EVALUATION RESULT | POOR | GOOD | GOOD |

CAM FOLLOWER

BACKGROUND OF THE PRESENT INVENTION

The present invention relates to a cam follower having a roller which is in rolling contact with a cam of an engine, and more particularly to the prevention of occurrence of peeling in the roller and pitching in the mating cam.

In a related cam follower, innumerable minute concave depressions are formed randomly on an outer surface of a roller so as to enhance an oil film forming coefficient on an outside-diameter rolling surface thereof to thereby secure a sufficient oil film thickness, whereby a contact portion of the roller is prevented from being brought into contact with metal, so as to prevent the occurrence of peeling damage to and wear of the outside-diameter rolling surface of the roller regardless of the surface roughness of the surface of the mating cam, thereby making it possible for the roller to obtain a long service life (refer to, for example, Japanese Patent Publication No. 2594339).

In the related cam follower, although the occurrence of peeling in the outside-diameter rolling surface of the roller can be prevented by forming randomly innumerable minute concave depressions on the outer surface of the roller, in the event that the hardness of the cam is low, since the contact surface pressure between roughness projections of the roller is high due to the contact area being small, there has been caused a problem that pitching is produced in the mating cam.

SUMMARY OF THE INVENTION

The invention was made with a view to solving the problem and object thereof is to obtain a cam follower which is constructed to prevent the occurrence of peeling in a roller thereof and occurrence of pitching in a mating cam.

In order to solve the above problem, the present invention is characterized by having the following arrangements.

(1) A cam follower comprising a roller which is in rolling contact with a cam of an engine, wherein a surface roughness of an outer surface of the roller, which is obtained respectively in an axial direction and circumferential direction satisfies the following inequalities:
   - a skewness Rsk of a profile of the surface roughness<0,
   - a core roughness depth Rk≦0.3;
   - a reduced valley depth Rvk≦0.3; and
   - a ratio Rk/Rt of the Rk to a maximum height Rt of the profile≧0.19.

(2) The cam follower according to (1), wherein the roller is made to have a hardness of Rockwell C 58 or more, and wherein the kurtosis Rku of the profile of the surface roughness of the outer surface of the roller is made to be 8 or less.

(3) The cam follower according to (1), wherein a reduced peak height Rpk of the surface roughness of the outer surface of the roller is made to be 0.08 or less.

In the cam follower of the invention, the roughness is measured according to JISB0601:01, ISO4287:97 and ISO1302:02. In the cam follower of the invention, since the surface roughness of the outer surface of the roller of the cam follower which is in rolling contact with the cam of the engine is obtained individually in the axial direction and the circumferential direction and the skewness Rsk of the profile is formed to be negative, the occurrence of peeling in the roller can be prevented, and since the core roughness depth Rk (JIS B0671:02, ISO13565:98) is made to be 0.0.3 or less, the reduced valley depth Rvk is made to be 0.3 or less and the ratio Rk/Rt of the Rk to the maximum height Rt of the profile is made to be 0.19 or more, the pitching of the mating cam can be prevented so as to allow the cam to be used without being damaged, whereby there is provided an advantage of realizing an enhancement in durability of the cam and the roller.

In addition, since the roller of the cam follower is made to have a hardness of Rockwell C 58 or more and the kurtosis of the profile of the surface roughness of the outer surface of the roller is made to be 8 or less, even though the roller is hard, the sharpness is decreased, whereby there is caused no risk that the surface of the mating cam is damaged.

Furthermore, since the height Rkp of the projecting peak portion of the surface roughness of the outer surface of the roller of the cam follower is made to be 0.08 or less, the level height of the core portion can actually be increased so that load can be applied in a stable fashion.

BRIEF DESCRIPTION OF THE DRAWINGS

FIG. 2 is a table showing the results of an evaluation of the invention and a conventional example in such a state that various parameters of surface roughness are set.

DETAILED DESCRIPTION OF PREFERRED EMBODIMENTS

Figure 1:
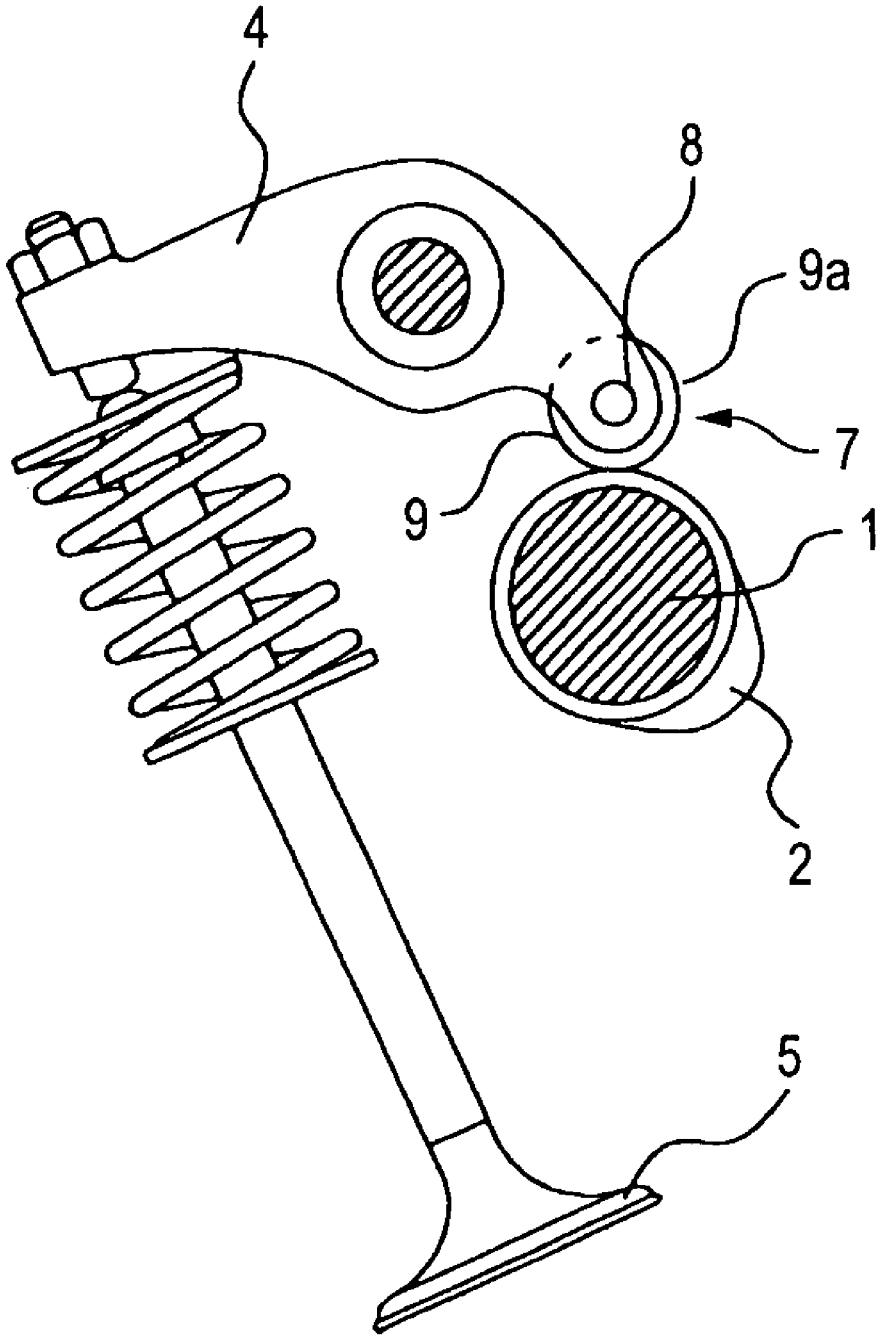
FIG. 1 is a vertical sectional view showing a state in which a cam follower with a roller according to the invention is in use.

FIG. 1 is a vertical sectional view showing a state in which a cam follower according to Embodiment 1 of the invention is in use, and FIG. 2 is a table showing the results of an evaluation of the invention and a conventional example in such a state that various parameters of surface roughness are set.

FIG. 1 shows a cam follower of an OHC engine, and a rocker arm 4 is directly activated by a cam 2 of a cam shaft 1, whereby a valve 5 is made to be opened and closed by rocking of the rocker arm 4. A cam follower 7 having a roller 9 which is in rolling contact with a circumferential surface of the cam 2 is rotatably mounted on a support shaft 8 which is rotatably supported on the rocker arm 4 at an end portion of the rocker arm 4 which oppositely faces the cam 2.

Next, there will be described surface properties of the cam 2 and the roller 9 of the cam follower 7 which prevent the occurrence of peeling and pitching in the cam 2 and the roller 9, respectively.

Prior to starting the description thereof, the hardness of the roller 9 and the cam 2 will be described. The roller 9 is formed to have a hardness of Rockwell C 58 or more, and the cam 2, which is a mating component with which the roller 9 is in rolling contact, is formed to have a hardness of Rockwell C 58 to 40. When hardness is expressed by Rockwell C hardness, a greater number indicates a higher hardness, and normally, the hardness of the roller 9 is set to be higher than that of the cam 2.

Next, the surface roughness of an outer surface of the roller 9 is expressed by various parameters which are obtained respectively in an axial direction and a circumferential direction.

In Embodiment 1, the surface roughness of the roller 9 is formed in such a manner that a skewness Rsk of a profile becomes negative.

When the roller 9 is formed in such a manner that the Rsk becomes negative, projecting portions on the surface of the roller 9 are removed so as to form oil reservoirs in the surface thereof, whereby the occurrence of peeling is prevented.

Parameters, which will be described below, are set so as to prevent the pitching of the cam 2 by increasing the contact area of roughness projections of the roller 9 and the cam 2.

The surface roughness of the roller 9 is measured according to JISB0601:01, ICO4287:97, ISO1302:02. The surface roughness of the roller 9 is formed in such a manner that the core roughness depth Rk becomes 0.3 or less.

The Rk is a kind of height property by a linear load curve in lubricity evaluation parameters for a surface of a plateau construction according to JISB0671:02, ISO13565:98. Here, the "core roughness depth Rk" means a difference between an upper level and a lower level in a core profile. By setting the Rk 0.3 or less, projecting peak portions and projecting valley portions are formed few and a portion represented by the core profile is increased, whereby load can be applied in a stable fashion.

Consequently, a reduced peak height Rpk, which is a kind of height property by a linear load curve, is set to be, for example, as small as 0.08 or less, and a reduced valley height Rvk is also set to be, for example, as small as 0.3 or less so that grooves become few which are so deep that no load can be applied thereto.

Here, the "reduced peak height Rpk" means the mean height of the peaks protruding from the roughness core profile, and the "reduced valley height Rvk" means the mean depth of the valleys protruding from the roughness core profile.

Furthermore, a ratio of the core roughness depth Rk to a maximum height Rt of the profile which indicates a total roughness, which will be described below, is set to be small.

Namely, the surface of the roller 9 is formed in such a manner that a ratio Rk/Rt of the Rk to the maximum height Rt of the profile is 0.19 or more.

Here, the "maximum height Rt of the profile" means a sum of a height of the highest peak and a depth of deepest valley in the profile over an evaluation length.

In addition, the surface roughness of the roller 9 is formed in such a manner that the kurtosis Rku of the profile is 8 or less.

The Rku is a kind of characteristic average parameter in the height direction and is such as to indicate sharpness. A smaller Rku value indicates that the sharpness of the profile becomes smaller. By forming the surface roughness of the roller 9 in such a manner as that Rku<8, the sharpness is decreased so as not to damage a cam surface of the mating cam.

When finishing the outer surface of the roller 9 to obtain thereon the roughened outer surface conditions described above, a desirably finished surface can be obtained through a special barrel polishing.

As a working method, a method is used in which irregularities are formed at random on the surface of a roller using chips by, for example, a centrifugal barrel polishing method and thereafter the surface of the roller is washed, and furthermore, a surface finishing treatment is applied to the washed surface of the roller by the barrel polishing method, whereby a desired surface can be formed on the roller.

By setting the roughened outer surface conditions of the roller 9 on to the outer surface thereof, the occurrence of peeling in the roller 9 can be prevented, and even though the mating cam is made to have a hardness of Rockwell C 40, the pitching of the mating cam can be prevented, whereby the mating cam can be used without being damaged, thereby making it possible to realize an enhancement in durability of the cam 2 and the roller 9.

A table in FIG. 2 is such as to show the results of an evaluation of the invention and the conventional example, which will be described below.

Note that in the table shown in FIG. 2, the invention is represented by Example 1 and Example 2 which were made by changing values of the parameters.

In addition, test conditions used to obtain the evaluation results were as follows.

(I) The same test engine was used for both the invention and the conventional example, and rocker arms of the OHC engine were used as test samples.

(II) Rollers of the same shape and dimensions were used for both the invention and the conventional example.

Outside diameter 17 mmϕ×width 7.5 mm×roller inscribed diameter 8.3 mmϕ

(III) Test Operating Conditions

Engine speed 8000 rpm

Engine oil temperature 125° C.

(IV) Test Operating Time 1500 hours in continuous operation

Looking at the table showing the results of the evaluation, with the conventional example, Rk was 0.34, which is 0.3 or more, Rvk was 0.37, which is 0.3 or more, and Rk/Rt was 0.17, which is 0.19 or less, and the evaluation was poor, which indicates that peeling and pitching were produced.

In contrast with the conventional example, with Example 1 of the invention, Rk was 0.30, which is 0.3 or less, Rvk was 0.26, which is 0.3 or less, and Rk/Rt was 0.20, which is 0.19 or more, and the evaluation was good, which indicates that peeling and pitching were not produced. In addition, with Example 2 of the invention, Rk was 0.23, which is 0.3 or less, Rvk was 0.30, which is 0.3 or less, and Rk/Rt was 0.19, which is 0.19 or more, and the evaluation was good, which indicates that peeling and pitching were not produced.

What is claimed is:

1. A cam follower comprising a roller which is in rolling contact with a cam of an engine, wherein a surface roughness of an outer surface of the roller, which is obtained respectively in an axial direction and circumferential direction satisfies the following inequalities:

a skewness Rsk of a profile of the surface roughness<0, a core roughness depth Rk≦0.3;

a reduced valley depth Rvk≦0.3; and a ratio Rk/Rt of the Rk to a maximum height Rt of the profile≧0.19.

2. The cam follower according to claim 1, wherein the roller is made to have a hardness of Rockwell C 58 or more, and wherein the kurtosis Rku of the profile of the surface roughness of the outer surface of the roller is made to be 8 or less.

3. The cam follower according to claim 1, wherein a reduced peak height Rpk of the surface roughness of the outer surface of the roller is made to be 0.08 or less.

* * * * *